United States Patent [19]

Marianeschi et al.

[11] 4,167,963

[45] Sep. 18, 1979

[54] METHOD AND APPARATUS FOR FEEDING MOLTEN METAL TO AN INGOT DURING SOLIDIFICATION

[75] Inventors: Edmondo Marianeschi; Gennaro Versaci, both of Terni, Italy

[73] Assignee: Terni-Societa per l'Industria e l'Elettricita S.p.A., Rome, Italy

[21] Appl. No.: 874,475

[22] Filed: Feb. 2, 1978

[30] Foreign Application Priority Data

Feb. 4, 1977 [IT] Italy ..... 47937/77

[51] Int. Cl.[2] ..... B22D 27/02

[52] U.S. Cl. ..... 164/52; 164/252

[58] Field of Search ..... 164/50, 52, 250, 252; 13/9 ES; 75/10 C, 10 R

[56] References Cited

U.S. PATENT DOCUMENTS 4,055,215 10/1977 Ramacciotti et al. ..... 164/252

FOREIGN PATENT DOCUMENTS 1162094 1/1964 Fed. Rep. of Germany ..... 164/52

*Primary Examiner*—Othell M. Simpson
*Assistant Examiner*—K. Y. Lin
*Attorney, Agent, or Firm*—Young & Thompson

[57] ABSTRACT

Molten metal is fed to an ingot during solidification, in order to compensate for shrinkage and segregation, by electroslag remelting (ESR). The electrodes are positioned entirely in the slag and comprise an inner electrode surrounded by an outer electrode, so that current flow is substantially horizontal through the slag. Powdered solid slag can be filled in the space between the electrodes before ESR begins; and for this purpose, the lower end of the outer or surrounding electrode is temporarily closed by a metal sheet which melts when the current is turned on, thereby to release molten slag onto the bath at the top of the ingot. The electrode arrangement is useful both with consumable and with nonconsumable electrodes.

6 Claims, 2 Drawing Figures

METHOD AND APPARATUS FOR FEEDING MOLTEN METAL TO AN INGOT DURING SOLIDIFICATION

Figure 1:
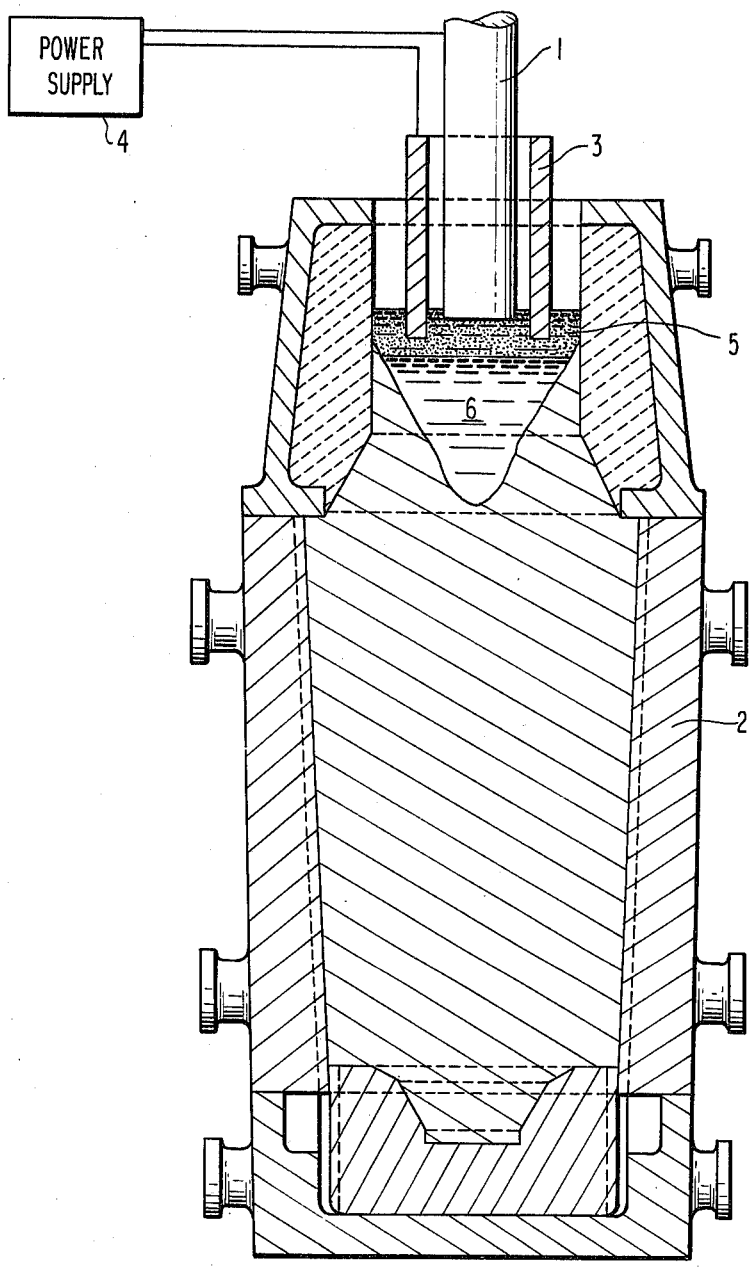

The present invention relates to methods and apparatus for adding molten steel to an ingot during solidification in a mold, in order to reduce the non-uniformity of structure which is caused by shrinkage and segregation.

Shrinkage voids are caused by the reduction in volume and/or by the physical-chemical transformations which the steel undergoes during cooling. These cavities can be of varying sizes and are more or less scattered throughout the mass of the ingot. Generally, they are localized in the upper portion of the ingot and may also appear at varying depths along the central upright axis of the ingot.

Segregation occurs as a result of the variations with temperature of the solubility of the alloying elements present in the iron as additions and/or impurities. Segregation is particularly pronounced during the transition from liquid phase to solid phase, and cause non-uniformity of concentration along the upright central axis and also in horizontal planes of the ingot.

In practice, segregation zones and shrinkage voids are maintained within acceptable limits by cropping the portions of the ingot where these defects are principally concentrated, for example, 15% to 30% of the ingot. Nevertheless, these defects remain present to a greater or lesser extent in the remaining portions of the ingot which is to be worked subsequently into the finished product, causing a lowering of the quality of the resulting product, and in some cases, its rejection for low quality. The most critical alloying element necessitating control when attempting to eliminate non-uniformity of composition in the ingot is carbon.

Several methods have been developed in recent years for minimizing the effects of these phenomena as well as for dealing with the problems that arise from the solidification pattern. In particular, exothermic hot-tops for ingot molds have been proposed; but their performance has been disappointing. It was also proposed to top-up the mold during solidification of the ingot with additional molten steel having a low carbon content and low content in the other more readily segregating elements. The object of this latter method was to dilute the molten steel and to lower the concentration of at least the two elements most prone to segregate, namely, carbon and sulfur.

In these prior techniques such as hot-topping and topping-up, additions of molten steel were made at intervals during ingot solidification, the necessary topping-up metal being drawn from a molten bath having a controlled specific composition. However, this method had the drawback that a solid layer of oxidation products formed on the upper end of the ingot during the long intervals of time between successive topping-up operations. Removal of this layer prior to pouring the next addition of steel proved to be an extremely difficult operation which was accompanied by inevitable rabbling effects and by the danger of polluting the ingot with non-metallic inclusions.

When electroslag remelting techniques (ESR) proved to be useful, it was recognized that they could be used to provide a continuous flow of liquid steel for topping-up purposes which would offer a high degree of control both of shrinkage and of segregation.

Although the results obtained with ESR in this connection have to date been generally satisfactory, nevertheless, certain problems have arisen which have remained unsolved until the advent of the present invention. Some of these disadvantages arise from the fact that the electric circuit supplying the necessary power is completed between a consumable or nonconsumable electrode, and the base of the mold. As a result, current flows through the molten pool and the associated electromagnetic field sets up turbulent flows within the liquid metal which can disrupt the solidification front and entrap slag and refractory particles in the ingot.

Furthermore, with this kind of circuit, the length and complexity of the electrical path are often considerable, owing to the unfavorable geometrical configuration of the system and the often considerable size of the ingots. The circuit therefore has a high impedance and introduces considerable phase shift, thus lowering the efficiency of the system and increasing the cost of the power supply and requiring in fact a greatly overdesigned power system.

It is an object of the present invention to overcome these disadvantages of known ESR techniques used in this connection.

It is also an object of the present invention to provide methods and apparatus for feeding molten metal to an ingot during solidification in order to compensate for shrinkage and segregation, using ESR techniques, which will overcome the above disadvantages.

Briefly, the present invention achieves these objects by providing a new type of electrode assembly in an ESR environment, the electrode assembly comprising a pair of electrodes one of which is an inner electrode or electrodes and the other of which comprises a tubular casing surrounding the first electrode or electrodes, with a suitable space between the two to comprise the current flow path.

Both electrodes may be consumable or nonconsumable, or one consumable and the other nonconsumable, and may be water cooled or not. If consumable electrode technique is used, then preferably only the inner electrode is of the consumable type.

The new electrode assembly of the present invention is immersed only in the conductive slag layer above the bath of molten metal. Therefore, the flow of electric current is almost entirely restricted to flow through that conductive slag layer. At most, only the uppermost layers of the underlying molten metal pool are included in the current flow path. Thus, it is possible to achieve a very accurate regulation of the rabbling streams generated by the current within the molten metal.

Also, it is possible, by use of the present invention, to do away with separate slag melting equipment; and it is no longer necessary to place solid slag on top of the molten pool of metal during start-up operations.

In an initial phase of the practice of the present invention, the powdered or otherwise suitably dimensioned solid slag is introduced into the space between the lower ends of the electrodes; and for this purpose, a metal sheet is welded across the bottom of the lower end of the outer electrode, which thus creates a temporary cup for the solid slag. This sheet is welded to the outer electrode before the inner electrode is inserted. After insertion of the inner electrode, then the comminuted slag is introduced.

In this way, the complete assembly can be prepared beforehand and then positioned in the mold above the molten pool, ready for operation.

When power is switched on, the slag and metal sheet melt, and the molten slag flows out onto the top of the molten pool, after which the process of feeding new molten metal to the ingot can be initiated so as to compensate for shrinking and segregation.

Figure 2:
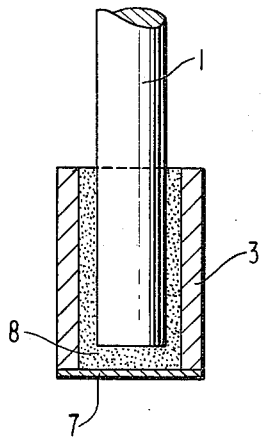

These and other objects, features and advantages of the present invention will become apparent from a consideration of the following description, taken in connection with the accompanying drawing, in which:

FIG. 1 is a side cross-sectional view of an ingot mold equipped with an electrode assembly according to the present invention for ESR refining; and FIG. 2 is a cross-sectional view of the electrode assembly just before the current is turned on.

Referring now to the drawing in greater detail, there is shown apparatus according to the present invention, comprising a first or inner electrode 1 positioned centrally with respect to an ingot mold 2, that is, coaxial with the vertical axis of the mold. A second electrode 3 comprises a tubular casing coaxial with and spaced radially outwardly from electrode 1.

In the case of very large ingots or of blooms of rectangular cross section with one side much longer than the other, electrode 1 can be replaced by two or more electrodes, all connected to the same terminal of the power supply 4. Hollow electrode 3 will then be appropriately shaped according to the ingot geometry.

Both of electrodes 1 and 3 may be consumable or nonconsumable. If nonconsumable, they are preferably of graphite or water-cooled metal. Of course, when both electrodes are of the nonconsumable type, they supply only the heat necessary for the molten pool, the metal required for topping-up the ingot being added separately either in powdered form or simply as molten metal. On the other hand, if one or both electrodes are of the consumable type, its or their chemical composition can be selected in such a way that the liquid metal entering the ingot mold has on the average the exactly required composition, as is already known in this art.

In any event, whatever the number and type of electrodes used, the central electrode or electrodes 1 must always be connected to one terminal and the tubular electrode 3 to the opposite terminal of the power supply 4.

When the power is switched on, the current will flow from one electrode to the other across the slag bath 5, or at most across the slag bath and the upper layers of the molten pool 6.

By adjusting the depth to which the electrodes are immersed in the slag, it is possible to regulate the power feed and to control the circulatory streams that are set up within the molten material by the current flow between the electrodes.

An additional advantage of the present invention is that the electrical impedance of the system remains practically constant during operation, since the geometry and characteristics of the electrical circuit undergo very limited variations. This is quite effective for insuring a high degree of control.

As a result, it is possible not only to obtain optimum distribution of the alloying elements within the body of the ingot and thus to provide greater freedom from segregation, but also to insure removal of non-metallic inclusions such as slag particles from the molten bath and to establish the optimum solidification front for preventing the formation of cavities and porosity within the ingot.

FIG. 2 shows in cross section the electrode assembly at a preliminary stage of the operation. The outer or tubular electrode 3 has been provided across its open lower end with a steel sheet 7 welded thereto, which closes the lower end of electrode 3 and forms a temporary cup. The first or central electrode 1 has then been inserted to a position in which its lower end is spaced above sheet 7; and the required quantity of powdered slag 8 has been inserted in the cup thus formed, surrounding the sides and bottom of the lower end of electrode 1 and resting on the upper side of sheet 7. The assembly thus formed is positioned with its lower end in the upper end of the ingot, coaxially therewith, and with sheet 7 spaced above the upper surface of the molten sheet.

When the current is turned on, its flow between the electrodes 1 and 3 and sheet 7, through the powdered slag, will cause the powdered slag 8 to melt by electric resistance heating and also the sheet 7 to melt for the same reason. The now-molten slag will spread out over the surface of the molten pool 6 to the position shown in FIG. 1, whereupon the ESR technique proceeds as described above.

To enable those skilled in this art to practice the invention, the following illustrative examples are given:

EXAMPLE 1

As an example of operation with non-consumable electrodes, 60 metric tons of molten steel was teemed into an a truncated conical mold whose height was 3,716 mm, whose lower base was 1,600 mm in diameter and whose upper base was 1,800 mm in diameter. The composition of the steel as teemed, in weight percent, was as follows:

C: 0.33
Si: 0.24
Mn: 0.68
S: 0.008
P: 0.010
Cr: 1.21
Ni: 0.50
Mo: 1.36
V: 0.30
Balance essentially iron.

There was positioned vertically over the molten steel in the mold an electrode assembly as in FIG. 2, with a thin steel sheet fastened to the bottom of the outer electrode. Both electrodes were graphite. The inner electrode was cylindrical and had a diameter of 265 mm and the outer electrode was hollow cylindrical having an outer diameter of 600 mm and a wall thickness of 60 mm. A powdered solid slag in the amount of 350 Kg rested on the steel sheet about the inner electrode and had a weight percent composition as follows:

$CaF_2$: 70
$Al_2O_3$: 25
CaO: 5

The steel sheet was positioned 200 mm above the surface of the bath. Electric current was then passed between the electrodes at 12,000 amperes and 24 volts, whereupon the slag and the steel sheet quickly melted and the slag formed a molten pool on top of the molten steel.

Cooling continued for about 15 hours, during which time the current was reduced from 12,000 to 8,000 amperes and the voltage from 24 to 19 volts in five regular steps. During cooling, the surface of the molten bath progressively fell by about 250 mm and then progressively rose again by about 150 mm. Throughout this vertical movement of the surface of the bath, the electrode tip was maintained at a distance of 200–220 mm from the metal, by correspondingly lowering and then raising the electrode assembly. Also during cooling, molten steel from an external source was added at a rate of 120 Kg per hour, for a total of 1,800 Kg added steel. The added steel had a weight percent composition as follows:

C: 0.08
Si: 0.05
Mn: 0.76
S: 0.013
P: 0.011
Cr: 1.08
Ni: 0.03
Mo: 1.25
V: 0.25
Balance essentially iron.

The resulting ingot tended to be free from pipe and segregation relative to ingots previously produced by ESR.

EXAMPLE 2

As an example of operation with consumable electrode, Example 1 was repeated, except that no molten steel was added from an external source. Instead, the inner electrode, which had the same dimensions as the graphite electrode of Example 1, was of steel and was of the same composition as the added steel in Example 1, except that the carbon was 0.12% by weight. Of course the central electrode was progressively lowered as consumed, in a conventional fashion. The steel addition from the consumable electrode was at the same rate as in Example 1, and the same high quality of cooled ingot was produced.

The steel compositions, ingot construction, electrode compositions, electrical connections, and rates of heating and cooling and further metal addition, may all be conventional for ESR techniques, except as expressly noted herein.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a process for the production of a large steel ingot with reduced defects due to shrinkage cavities and with reduced segregation, comprising teeming a quantity of liquid steel into an ingot mold, establishing a layer of electrically conductive liquid slag over said steel, immersing in said slag above said steel an electrode assembly comprising at least one central electrode and a tubular electrode surrounding and spaced from said at least one central electrode by a quantity of molten slag, and passing an electric current between said electrodes through said slag; the improvement comprising positioning the lower end of said electrode assembly above said molten steel with a free space between said lower end and said molten steel, temporarily closing the lower end of said tubular electrode, and positioning comminuted solid slag between said electrodes above said closed lower end prior to the passage of said current, whereby the passage of said current melts the solid slag.

2. A method as claimed in claim 1, at least one of said electrodes being consumable, and supplying metal to said liquid steel from said at least one consumable electrode.

3. A method as claimed in claim 1, both of said electrodes being nonconsumable, and supplying further steel to said molten steel from a source of supply external to said electrodes.

4. A method as claimed in claim 1, in which the closing of said lower end of said tubular electrode is effected with a sheet that melts by electric resistance heating after the current is turned on, thereby to open the lower end of the tubular electrode for downward passage of slag onto the surface of said molten steel.

5. In apparatus for the production of a large steel ingot with reduced defects due to shrinkage cavities and reduced segregation, comprising an electrode assembly adapted to be positioned centrally in the upper end of an ingot mold, said assembly comprising at least one central electrode, a tubular outer electrode surrounding said at least one central electrode in horizontally spaced relation, and means for connecting said electrodes to opposite terminals of a power supply; the improvement in which said central electrode terminates downwardly at a level above the level at which said tubular electrode terminates downwardly, and a metal sheet closing the lower end of said tubular electrode.

6. Apparatus as claimed in claim 1, and a quantity of comminuted solid electroconductive slag resting on the upper side of said sheet within the lower end of said tubular electrode and surrounding the lower end of said at least one central electrode.

* * * * *